US011768458B2

(12) United States Patent
Morishita

(10) Patent No.: US 11,768,458 B2
(45) Date of Patent: Sep. 26, 2023

(54) IMAGE FORMING APPARATUS INCLUDING DETACHABLE DRUM UNIT

(71) Applicant: KYOCERA Document Solutions Inc., Osaka (JP)

(72) Inventor: Hiroki Morishita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/046,324

(22) Filed: Oct. 13, 2022

(65) Prior Publication Data

US 2023/0121978 A1 Apr. 20, 2023

(30) Foreign Application Priority Data

Oct. 15, 2021 (JP) ..... 2021-169403

(51) Int. Cl.
*G03G 21/16* (2006.01)
*G03G 21/18* (2006.01)

(52) U.S. Cl.
CPC ..... *G03G 21/1647* (2013.01); *G03G 21/1671* (2013.01); *G03G 21/1676* (2013.01); *G03G 21/1821* (2013.01)

(58) Field of Classification Search
CPC ..... G03G 21/1647; G03G 21/1671; G03G 21/1676; G03G 21/1817; G03G 21/1821; G03G 21/1842; G03G 21/1853; G03G 2221/1853; G03G 2221/1869
See application file for complete search history.

(56) References Cited

U.S. PATENT DOCUMENTS 10,564,596 B2 * 2/2020 Itabashi ..... G03G 21/1842
2019/0278216 A1 * 9/2019 Tomatsu ..... G03G 21/1671

FOREIGN PATENT DOCUMENTS

JP 2002-108173 A 4/2002
JP 2004-151568 A 5/2004

* cited by examiner

*Primary Examiner* — Sophia S Chen
(74) *Attorney, Agent, or Firm* — Studebaker & Brackett PC

(57) ABSTRACT

An image forming apparatus includes a developing device, a drum unit, a side plate, a notch, a turning member and a biasing member. The developing device includes a developing roller. The drum unit includes a photosensitive drum and has a protrusion protruding in an axial direction of the photosensitive drum. Thea side plate faces an end surface of the drum unit in the axial direction. The notch is provided in the side plate. The turning member is capable of turning in a direction protruding into the notch and in a direction separating from the notch. The biasing member biases the turning member in a direction close to the notch. The turning member is pushed back by the protrusion inserted into the notch from above, and when the protrusion reaches a bottom of the notch, the turning member presses the protrusion against the notch by a load containing a downward component.

4 Claims, 9 Drawing Sheets

IMAGE FORMING APPARATUS INCLUDING DETACHABLE DRUM UNIT

INCORPORATION BY REFERENCE

This application is based on and claims the benefit of priority from Japanese patent application No. 2021-169403 filed on Oct. 15, 2021, which is incorporated by reference in its entirety.

BACKGROUND

The present disclosure relates to an image forming apparatus and a wiping method.

An electrophotographic type image forming apparatus is generally configured such that a drum unit including a photosensitive drum and a developing device are detachably provided. For example, there is a case in which a positioning portion and a receiving portion are provided on the main body side plate of the image forming apparatus main body, a first protrusion provided on a process cartridge is brought into pressure contact with the positioning portion, and a second protrusion is brought into pressure contact with the receiving portion to attach the process cartridge to the image forming apparatus main body. In some cases, both end portions of the shaft of the photosensitive drum are engaged with the rails of the printer main body, and the placement ribs of the developing device are placed on the placement surface of the printer main body from above, so that a part or all of the load of the developing device is received by the placement surface from below, and the process unit is supported by the printer main body.

In the case where the drum unit is attached after the developing device is attached, conventionally, the drum unit is fixed by operating a lever or the like. Also, a mechanism for preventing the operation from being forgotten is required.

SUMMARY

In accordance with an aspect of the present disclosure, an image forming apparatus includes a developing device, a drum unit, a side plate, an upwardly open notch, a turning member and a biasing member. The developing device includes a developing roller. The drum unit includes a photosensitive drum having an outer circumferential surface facing an outer circumferential surface of the developing roller each other and has a protrusion protruding in an axial direction of the photosensitive drum. Thea side plate faces an end surface of the drum unit in the axial direction. The upwardly open notch is provided in the side plate at an attachment position of the drum unit. The turning member is capable of turning in a direction protruding into the notch and in a direction separating from the notch along a direction crossing the axial direction. The biasing member biases the turning member in a direction close to the notch. The turning member is pushed back by the protrusion inserted into the notch from above, and when the protrusion reaches a bottom portion of the notch, the turning member presses the protrusion against the notch by a load containing a downward component.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
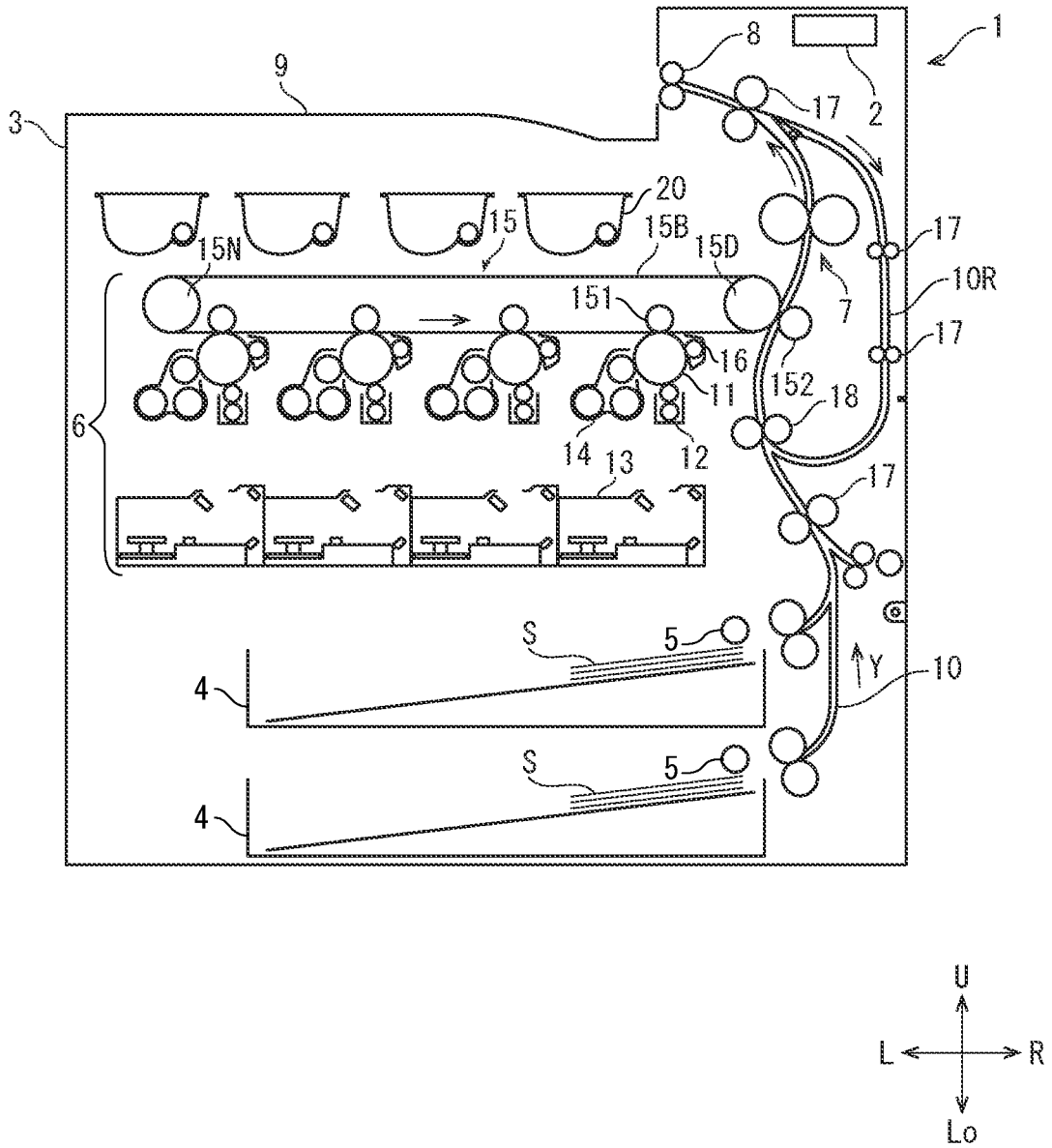
FIG. 1 is a front view schematically showing an inner structure of a printer according to one embodiment of the present disclosure.

First, an entire structure of a printer 1 (one example of an image forming apparatus) will be described. In the following description, a front side of a paper surface on which FIG. 1 is drawn is defined as a front side of the printer 1, and the left-and-right direction is based on a direction in which the printer 1 is viewed from the front side. Reference numerals U, Lo, L, R, Fr and Rr marked in each drawing indicate the upper, lower, left, right, front and rear.

The printer 1 includes a rectangular parallelepiped main housing 3 (an example of a main body). In the lower portion of the inside of the main housing 3, a sheet feeding cassette 4 in which a sheet S is stored and a sheet feeding roller 5 which feeds the sheet S rightward from the sheet feeding cassette 4 are provided. Above the sheet feeding cassette 4, an image forming device 6 which forms a toner image by an electrophotographic method is provided, and on the right upper side of the image forming device 6, a fixing device 7 which fixes the toner image to the sheet S is provided. Above the fixing device 7, a sheet discharging roller 8 which discharges the sheet S on which the toner image is fixed and a sheet discharge tray 9 on which the discharged sheet is stacked are provided.

Inside the main housing 3, a conveyance path 10 is provided from the sheet feeding roller 5 to the sheet discharging roller 8 via the image forming device 6 and the fixing device 7. The conveyance path 10 is formed mainly of plate-like members facing each other with a gap for passing the sheet S therethrough, and a conveying roller 17 which holds the sheet S and conveys it is provided at a plurality of positions in the conveyance direction Y. A registration roller 18 is provided on the upstream side of the image forming device 6 in the conveyance direction Y. On the right side of the fixing device 7, an inversion conveyance path 10R branching from the conveyance path 10 on the downstream side of the fixing device 7 in the conveyance direction Y and merging with the conveyance path 10 on the upstream side of the registration roller 18 in the conveyance direction Y is provided.

The image forming device 6 includes a photosensitive drum 11 whose potential is changed by irradiation of light, a charging device 12 which charges the photosensitive drum 11, an exposure device 13 which emits laser light according to image data, a developing device 14 which supplies toner to the photosensitive drum 11, an intermediate transferring unit 15 which transfers a toner image from the photosensitive drum 11 to the sheet S, and a cleaning device 16 which removes the toner remaining on the photosensitive drum 11.

The intermediate transferring unit 15 includes an endless intermediate transferring belt 15B stretched around a driving roller 15D and a driven roller 15N, a primary transferring roller 151 which faces the inner circumferential surface of the intermediate transferring belt 15B at a position corresponding to the photosensitive drum 11 and generates a primary transferring bias, and a secondary transferring roller 152 which faces the outer circumferential surface of the intermediate transferring belt 15B at a position corresponding to the driving roller 15D and generates a secondary transferring bias. A toner container 20 in which the toner supplied to the developing device 14 is contained is connected to the developing device 14.

The image forming device 6 includes four sets of the photosensitive drum 11, the charging device 12, the exposure device 13, the developing device 14, the primary transferring roller 151, the cleaning device 16, and the toner container 20, and forms a color image by superimposing the toner image of four colors on the intermediate transferring belt 15B. The present disclosure may be applied to an image forming apparatus that forms a color image with toners of three or less colors or five or more colors.

A controller 2 includes an arithmetic part and a storage part. The arithmetic part is a CPU (Central Processing Unit), for example. The storage part includes a storage medium such as ROM (Read Only Memory), RAM (Random Access Memory), EEPROM (Electrically Erasable Programmable Read Only Memory), or the like. The arithmetic part executes various processes by reading and executing the control program stored in the storage part. The controller 2 may be implemented by an integrated circuit without using software.

A basic image forming operation of the printer 1 is as follows. When a single-side printing job is input to the printer 1 from an external computer or the like, the sheet feeding roller 5 feeds the sheet S from the sheet feeding cassette 4 to the conveyance path 10, the registration roller 18 whose rotation is stopped corrects the skew of the sheet S, and the registration roller 18 feeds the sheet S to the image forming device 6 at a predetermined timing. In the image forming device 6, the charging device 12 charges the photosensitive drum 11 to a predetermined potential, the exposure device 13 writes an electrostatic latent image on the photosensitive drum 11, the developing device 14 develops the electrostatic latent image by using the toner supplied from the toner container 20 to form a toner image, the primary transferring roller 151 transfers the toner image to the intermediate transferring belt 15B, and the secondary transferring roller 152 transfers the toner image to the sheet S. Subsequently, the fixing device 7 melts the toner image and fixes it to the sheet S while holding the sheet S and conveying it, and the sheet discharging roller 8 discharges the sheet S to the sheet discharge tray 9. The cleaning device 16 removes the toner remaining on the photosensitive drum 11. In the case of double-sided printing, the sheet S having the toner image fixed on the first surface is fed to the conveyance path 10 via the inversion conveyance path 10R, whereby the toner image is transferred to the second surface of the sheet S.

Figure 2:
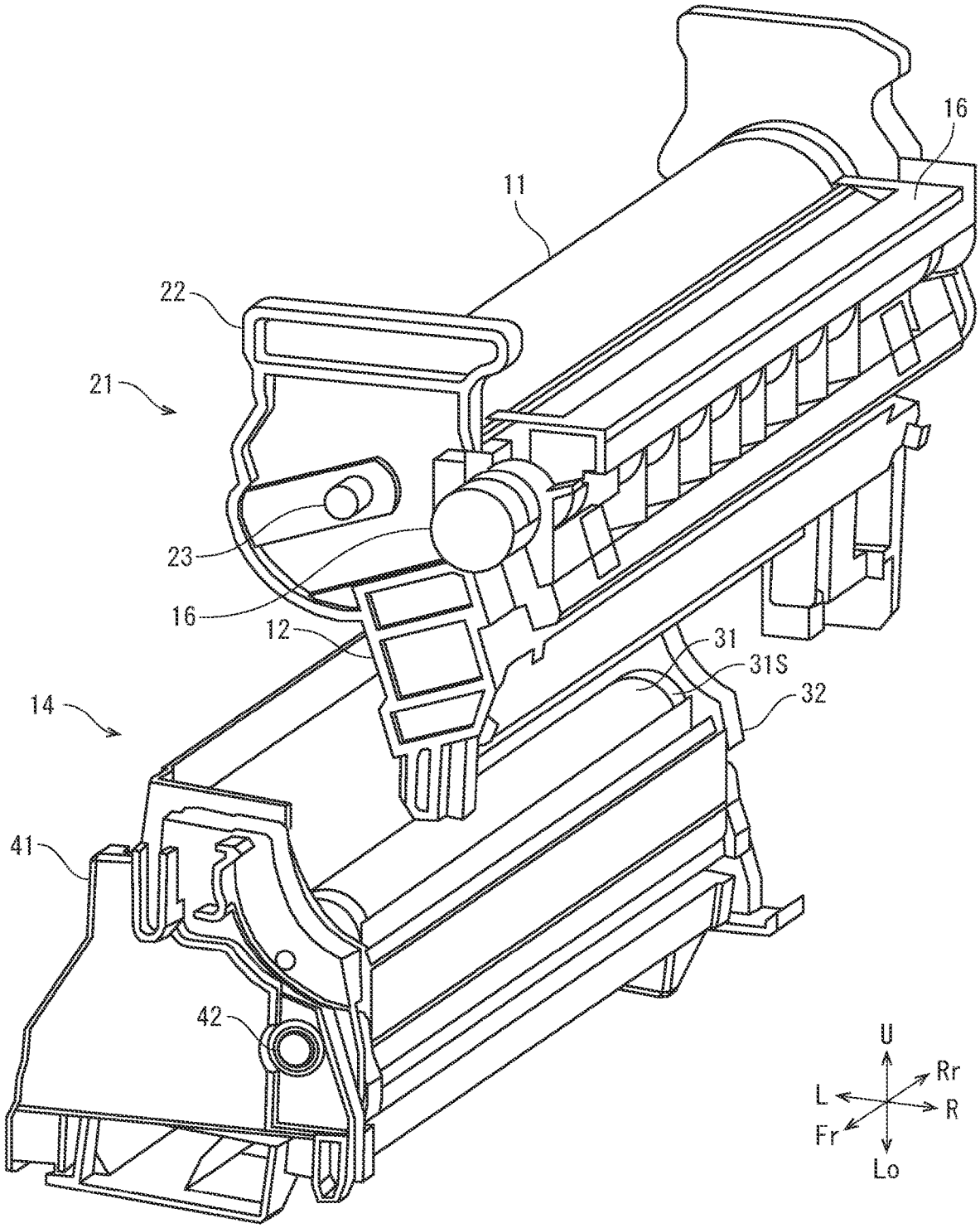
FIG. 2 is a perspective view showing a drum unit and a developing device according to the embodiment of the present disclosure.
Figure 3:
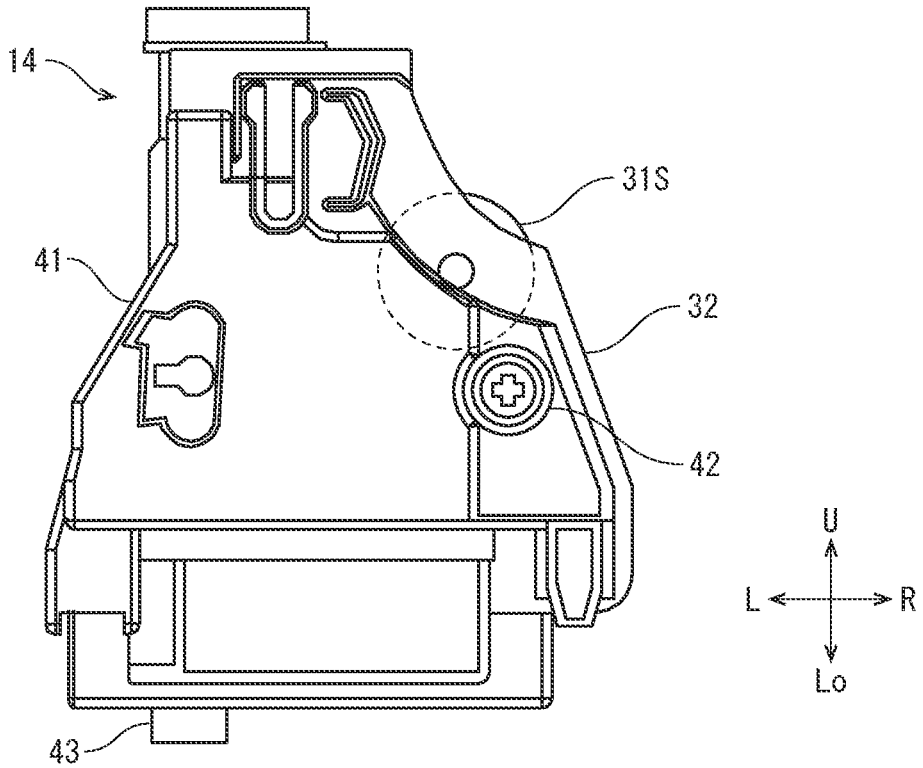
FIG. 3 is a front view showing the developing device, according to the embodiment of the present disclosure, positioned at a predetermined position in an image forming operation.
Figure 4:
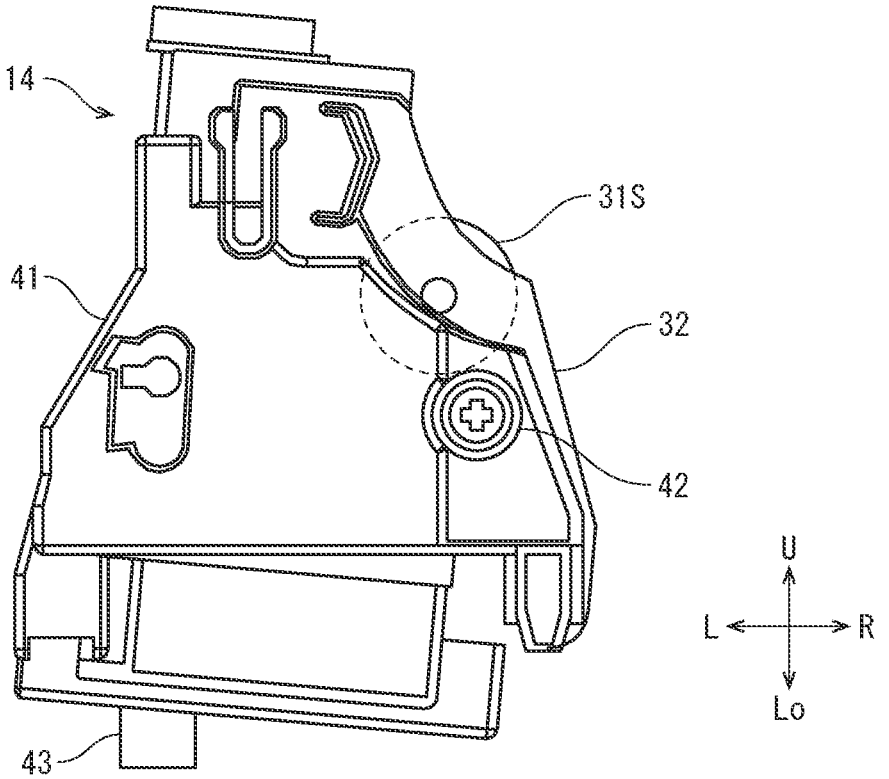
FIG. 4 is a front view showing the developing device, according to the embodiment of the present disclosure, positioned at a position closer to the drum unit than the predetermined position.

Next, a drum unit 21 and the developing device 14 will be described in detail. FIG. 2 is a perspective view showing the drum unit 21 and the developing device 14. FIG. 3 is a front view showing the developing device 14 positioned at a predetermined position in the image forming operation. FIG. 4 is a front view showing the developing device 14 positioned closer to the drum unit 21 than the predetermined position.

[Drum Unit] The drum unit 21 (see FIG. 2) is configured such that the photosensitive drum 11, the charging device 12 and the cleaning device 16 are unitized by a drum frame 22. The drum frame 22 is provided with a drum bearing 23 by which the drum shaft (not shown) of the photosensitive drum 11 is supported. The drum bearing 23 protrudes from the outer surface of the drum frame 22 (an example of a protrusion). The sheet discharge tray 9 is hinge-coupled to the main housing 3, and the drum unit 21 is attached to a predetermined position in the main housing 3 from above with the sheet discharge tray 9 opened.

[Developing Device] The developing device 14 includes a developer, a screw (not shown) which stirs the developer, a developing roller 31 on which the developer is held, and a developing housing 32 in which the developer, the screw, and the developing roller 31 are housed. The developer includes the toner and a magnetic carrier. The developing roller 31 has a rotating sleeve, and a magnet is provided inside the sleeve (not shown). The developing roller 31 attracts the developer by magnetic force and forms a magnetic brush on the surface of the sleeve. A part of the developing roller 31 is exposed from the developing housing 32. At both end portions of the developing roller 31, annular space regulating members 31S having a diameter larger than that of the sleeve are provided. The outer circumferential surface of the sleeve faces the outer circumferential surface of the photosensitive drum 11 at a predetermined space by bringing the space regulating member 31S contact with the outer circumferential surface of the photosensitive drum 11.

Supporting parts 41 face both front and rear end portions of the developing housing 32, and support the developing housing 32 so as to be turnable around a turning shaft 42 provided below the developing roller 31. The supporting part 41 is connected to the developing housing 32 by the turning shaft 42, and is unitized with the developing device 14. The developing device 14 is detachably attached to the main housing 3 in the upper-and-lower direction, and the supporting part 41 is fixed to the main housing 3.

A biasing part 43 is a compression coil spring, for example, and is provided in the main housing 3 to bias the developing housing 32 toward the drum frame 22. FIG. 3 shows the developing device 14 positioned at a predetermined position (a predetermined position in the image forming operation) when the drum unit 21 is attached to the main housing 3. On the other hand, FIG. 4 shows the state before the drum unit 21 is attached to the main housing 3, and the developing device 14 is positioned closer to the drum unit 21 than the predetermined position.

Figure 5:
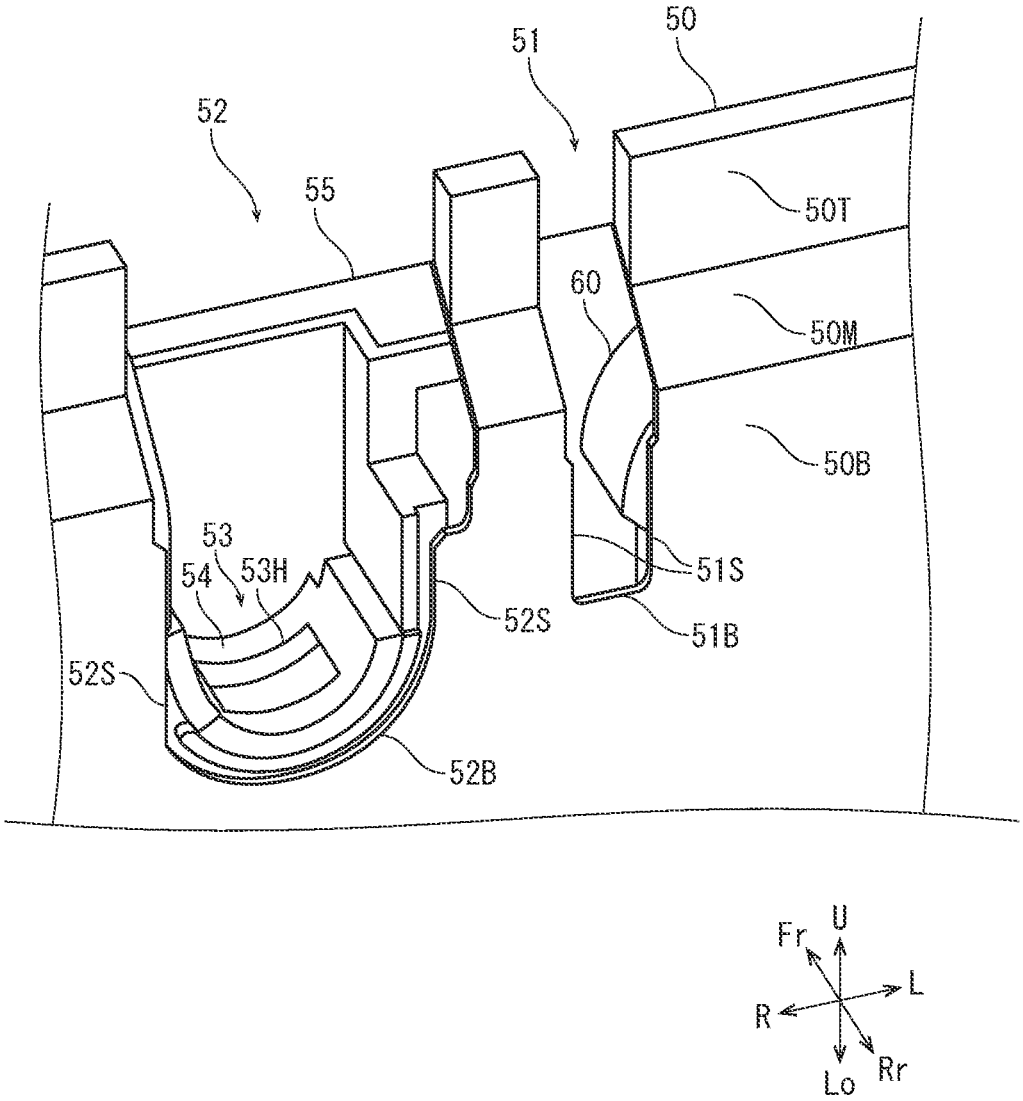
FIG. 5 is a perspective view showing a front end portion of the drum unit of a main housing according to the embodiment of the present disclosure.
Figure 6:
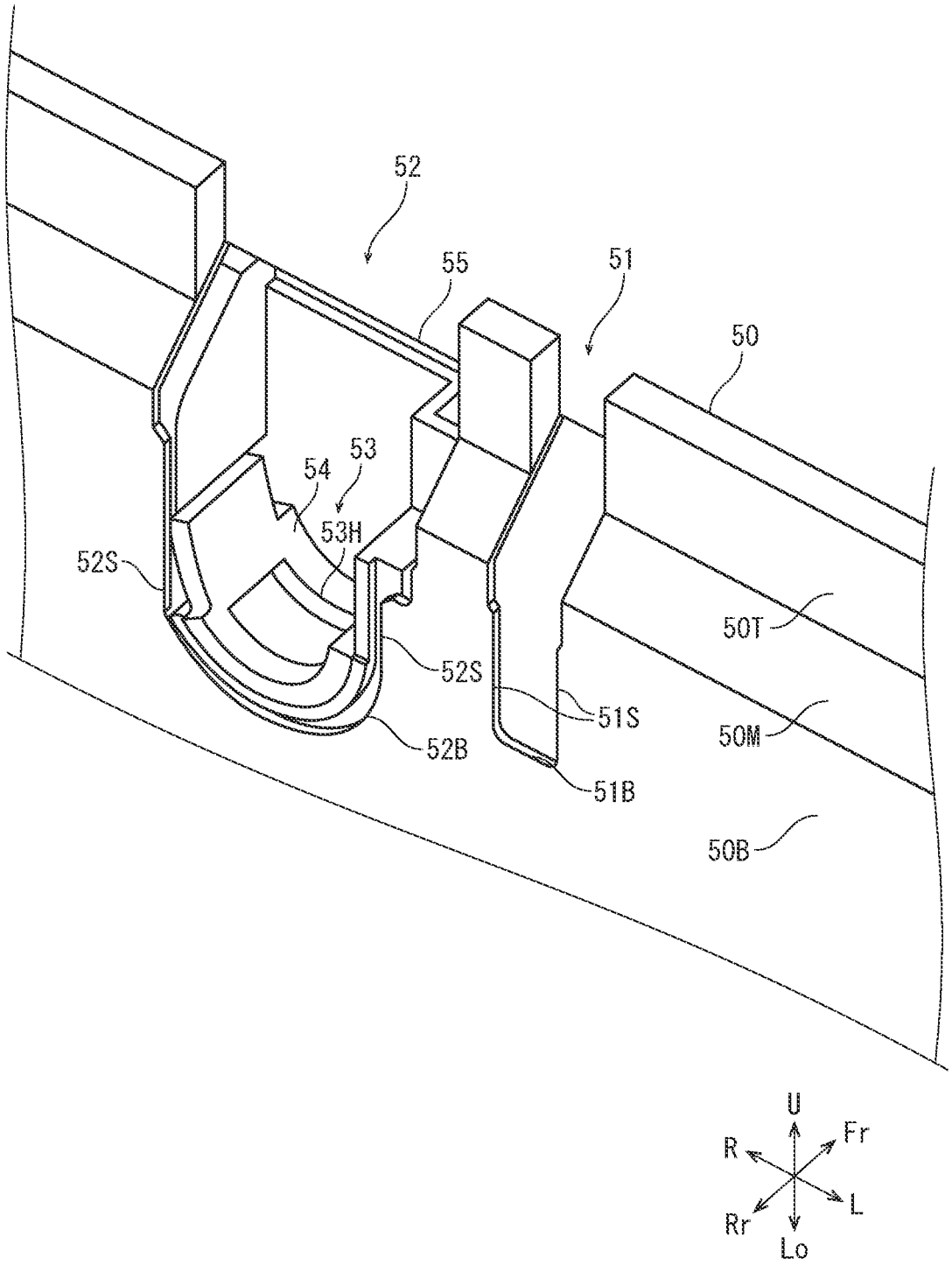
FIG. 6 is a perspective view showing the front end portion of the drum unit of the main housing according to the embodiment of the present disclosure.
Figure 7:
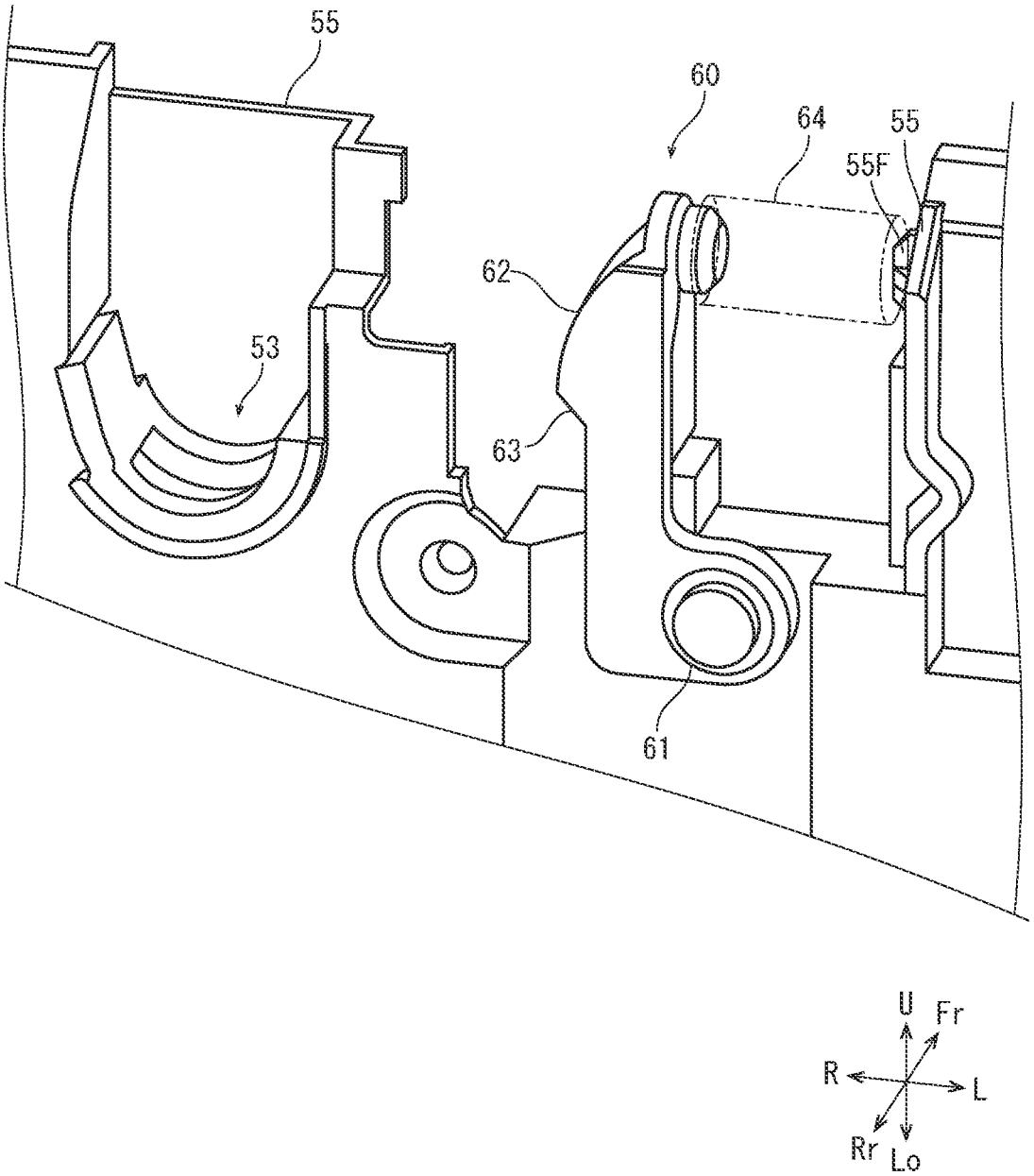
FIG. 7 is a perspective view showing the front end portion of the drum unit of the main housing according to the embodiment of the present disclosure.

Next, a configuration for supporting the drum unit 21 will be described. FIG. 5 to FIG. 7 are perspective views showing the front portion of the drum unit 21 of the main housing 3. Hereinafter, the front portion of the drum unit 21 of the main housing 3 will be described, but since the rear portion is configured in the same manner, the description of the rear portion will be omitted.

The printer 1 includes the developing device 14 including the developing roller 31; the drum unit 21 which includes the photosensitive drum 11 having an outer circumferential surface facing an outer circumferential surface of the developing roller 31 each other and has the drum bearing 23 (an example of the protrusion) protruding in the axial direction of the photosensitive drum 11; the inner side plate 50 (an example of the side plate) facing the end portion (the end surface) of the drum unit 21 in the axial direction; the upwardly open first notch 51 (an example of the notch) provided in the inner side plate 50 at the attachment position of the drum unit 21; the hook 60 (an example of the turning member) capable of turning along the inner side plate 50 in the direction crossing the axial direction; and the biasing member 64 which biases the hook 60 in a direction close to the first notch 51. The hook 60 is pushed back by the drum bearing 23 inserted into the first notch 51 from above, and when the drum bearing 23 reaches the bottom portion 51B of the first notch 51, the hook 60 presses the drum bearing 23 against the first notch 51 by a load containing a downward component.

The main housing 3 includes the inner side plate 50 (an example of a side plate) and an outer side plate 55. The inner side plate 50 is provided behind the outer side plate 55, that is, on the side close to the drum unit 21. The inner side plate 50 has an upper portion 50T, a lower portion 50B below the upper portion 50T, and an intermediate portion 50M connecting the upper portion 50T and the lower portion 50B. The lower portion 50B is positioned on the rear side (on the side close to the drum unit 21) than the upper portion 50T, and the intermediate portion 50M is inclined so that the rear end portion is positioned below the front end portion. The inner side plate 50 is provided with a first notch 51 and a second notch 52 which are opened upward. The first notch 51 and the second notch 52 reach a predetermined position of the lower portion 50B from at least the intermediate portion 50M.

The front drum bearing 23 of the drum unit 21 is inserted into the first notch 51. The first notch 51 has side portions 51S facing each other in the left-and-right direction, and the bottom portion 51B connecting the lower ends of the side portions 51S to each other. The side portions 51S are substantially vertical and the bottom portion 51B is substantially horizontal.

The front end portion of the cleaning device 16 of the drum unit 21 is inserted into the second notch 52. The second notch 52 has side portions 52S facing each other in the left-and-right direction, and a semicircular bottom portion 52B connecting the lower ends of the side portions 52S to each other. A joint portion 53 to which the front end portion of the cleaning device 16 is connected is provided in front of the bottom portion 52B. The joint portion 53 has a through hole 53H penetrating it in the upper-and-lower direction, and the waste toner discharged from the cleaning device 16 is guided to a waste toner container (not shown) through the through hole 53H. A sealing member 54 is provided around the through hole 53H to close the gap between the cleaning device 16 and the joint portion 53.

A hook 60 is provided on the left side of the first notch 51 in the space between the inner side plate 50 and the outer side plate 55. The hook 60 fixes the drum bearing 23 inserted into the first notch 51. The hook 60 is a member whose longitudinal direction is along the upper-and-lower direction, and the lower end portion of the hook 60 is supported by the outer side plate 55 via a turning shaft 61 whose axial direction is along the front-and-rear direction. The right side surface (the side surface on the side of the first notch 51) of the upper portion of the hook 60 has a curved portion 62 protruded rightward in an arc shape, and a planar inclined portion 63 connected to the lower end portion of the curved portion 62. The inclined portion 63 is inclined so that the lower end portion is positioned on the left side of the upper end portion.

A biasing member 64 is a compression coil spring, for example, and biases the hook 60 rightward. The outer side plate 55 has a facing portion 55F facing the left side surface of the upper portion of the hook 60, and the biasing member 64 is provided between the left side surface of the hook 60 and the facing portion 55F.

Figure 8:
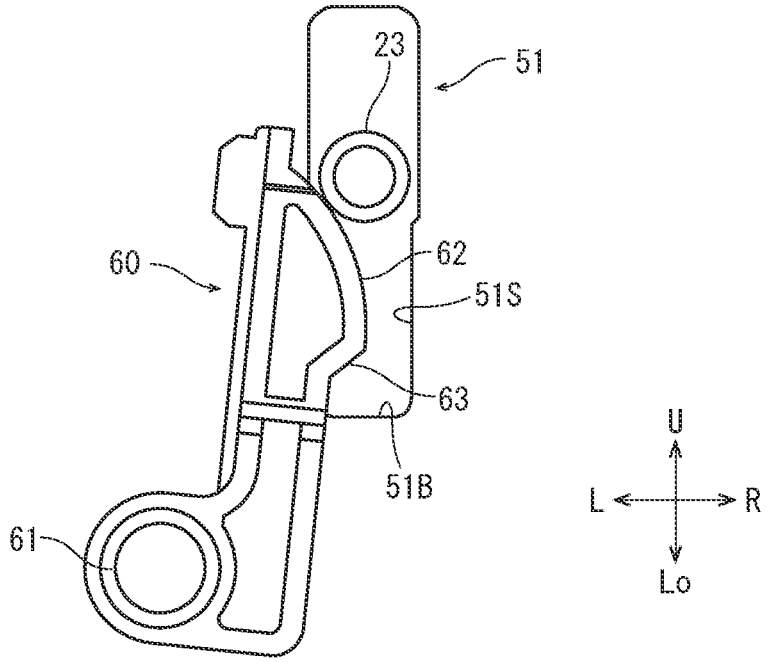
FIG. 8 is a front view explaining an operation of a hook according to the embodiment of the present disclosure.
Figure 9:
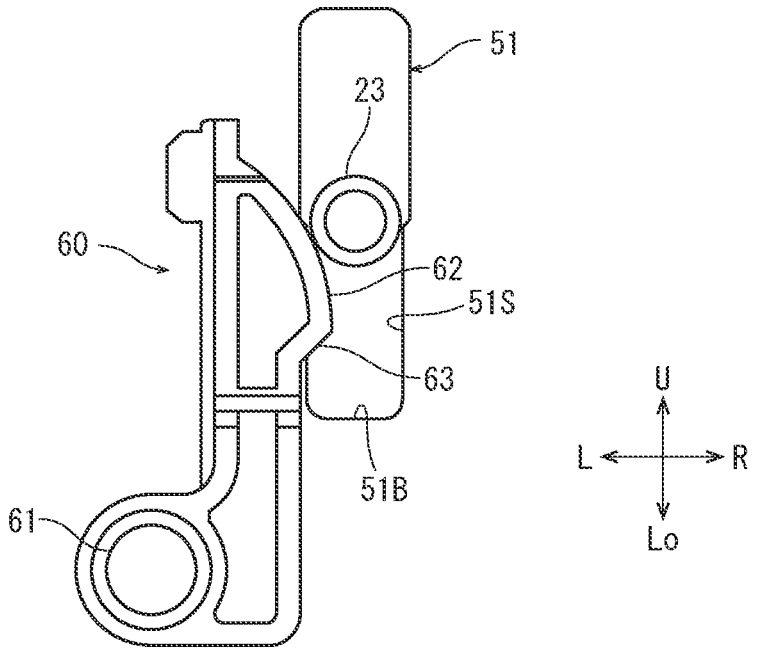
FIG. 9 is a front view explaining the operation of the hook according to the embodiment of the present disclosure.
Figure 10:
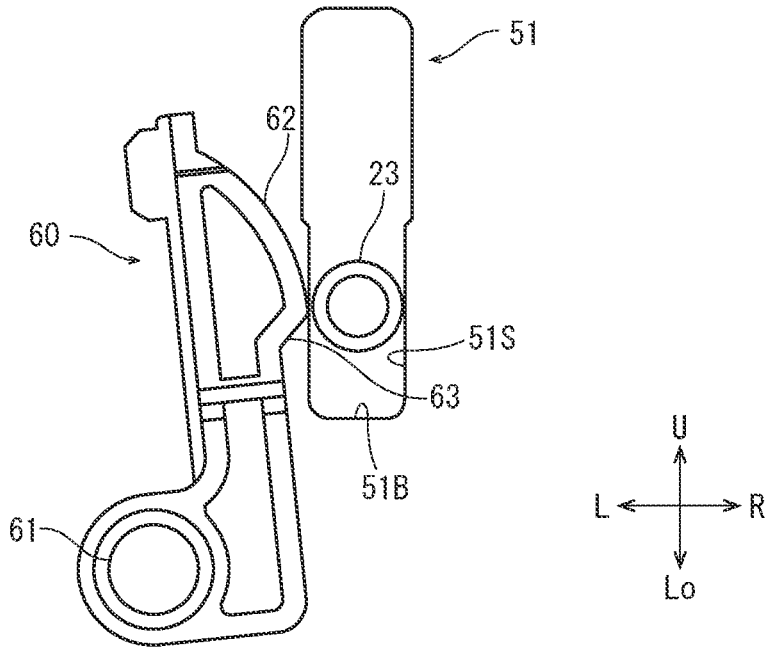
FIG. 10 is a front view explaining the operation of the hook according to the embodiment of the present disclosure.
Figure 11:
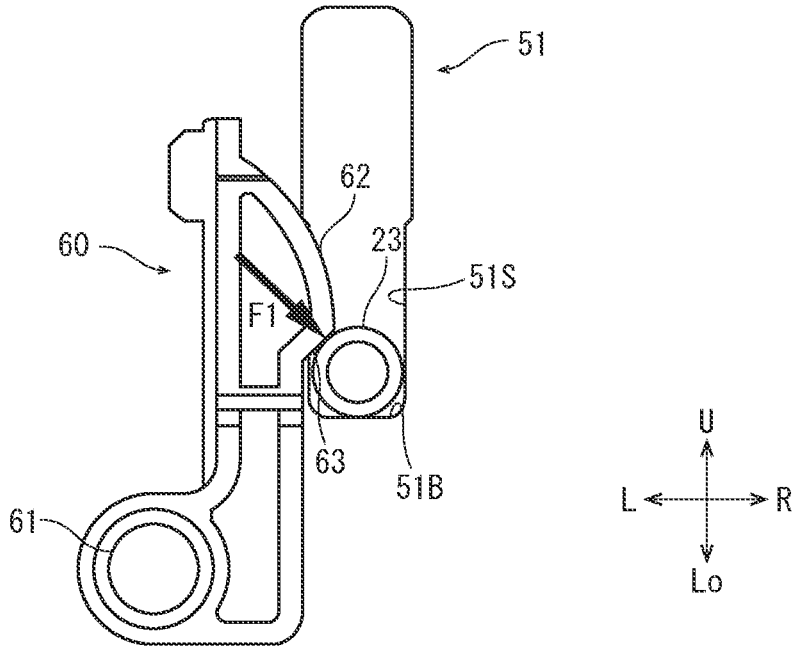
FIG. 11 is a front view explaining the operation of the hook according to the embodiment of the present disclosure.

Next, the operation of the above configuration will be described. FIG. 8 to FIG. 11 are front views explaining the operation of the hook 60. Here, the operation when the drum unit 21 is attached after the developing device 14 is attached will be described. Before the drum unit 21 is attached, as shown in FIG. 5 and FIG. 8, the upper end portion of the hook 60 is brought down by the biasing member 64 toward the first notch 51 and protrudes into the first notch 51.

When the user holds the drum unit 21, aligns the drum bearing 23 with the upper end portion of the first notch 51 while aligning the front end portion of the cleaning device 16 with the upper end portion of the second notch 52, and lowers the drum unit 21. The drum bearing 23 first comes into contact with the upper end portion of the curved portion 62 of the hook 60 (see FIG. 8). As the drum unit 21 is lowered, the contact position between the drum bearing 23 and the curved portion 62 is shifted downward, and the hook 60 is pushed away to the left (see FIG. 9). When the drum bearing 23 reaches the lower end portion of the curved portion 62, the hook 60 is pushed leftmost (see FIG. 10). When the drum unit 21 is further lowered, the drum bearing 23 comes into contact with the inclined portion 63 of the hook 60, and the hook 60 is pushed back rightward by the biasing member 64 (see FIG. 11).

At this time, the inclined portion 63 of the hook 60 comes into contact with the upper left portion of the outer circumferential surface of the drum bearing 23, and applies a load F11 in the lower right direction to the drum bearing 23. The drum bearing 23 is pressed against the right side portion 51S and the bottom portion 51B of the first notch 51 by the load F1. As a result, the drum bearing 23 is restrained at three points of the inclined portion 63 of the hook 60, the right side portion 51S and the bottom portion 51B of the first notch 51, so that the drum bearing 23 is accurately positioned.

If a planar inclined portion is provided instead of the curved portion 62, the inclined portion is displaced to a horizontal posture as the drum unit 21 is lowered, so that the upward component of the force by which the hook 60 pushes back the drum bearing 23 increases. Therefore, it is also necessary to increase the force with which the user pushes the drum unit 21.

On the other hand, in the present embodiment, the tangential direction of the curved portion 62 at the contact position between the drum bearing 23 and the curved portion 62 is substantially constant in the process in which the drum unit 21 is lowered. Therefore, when the drum unit 21 is lowered, the magnitude of the upward component of the force by which the hook 60 pushes back the drum bearing 23 hardly changes, so that the user can push in the drum unit 21 with almost constant force.

Figure 12:
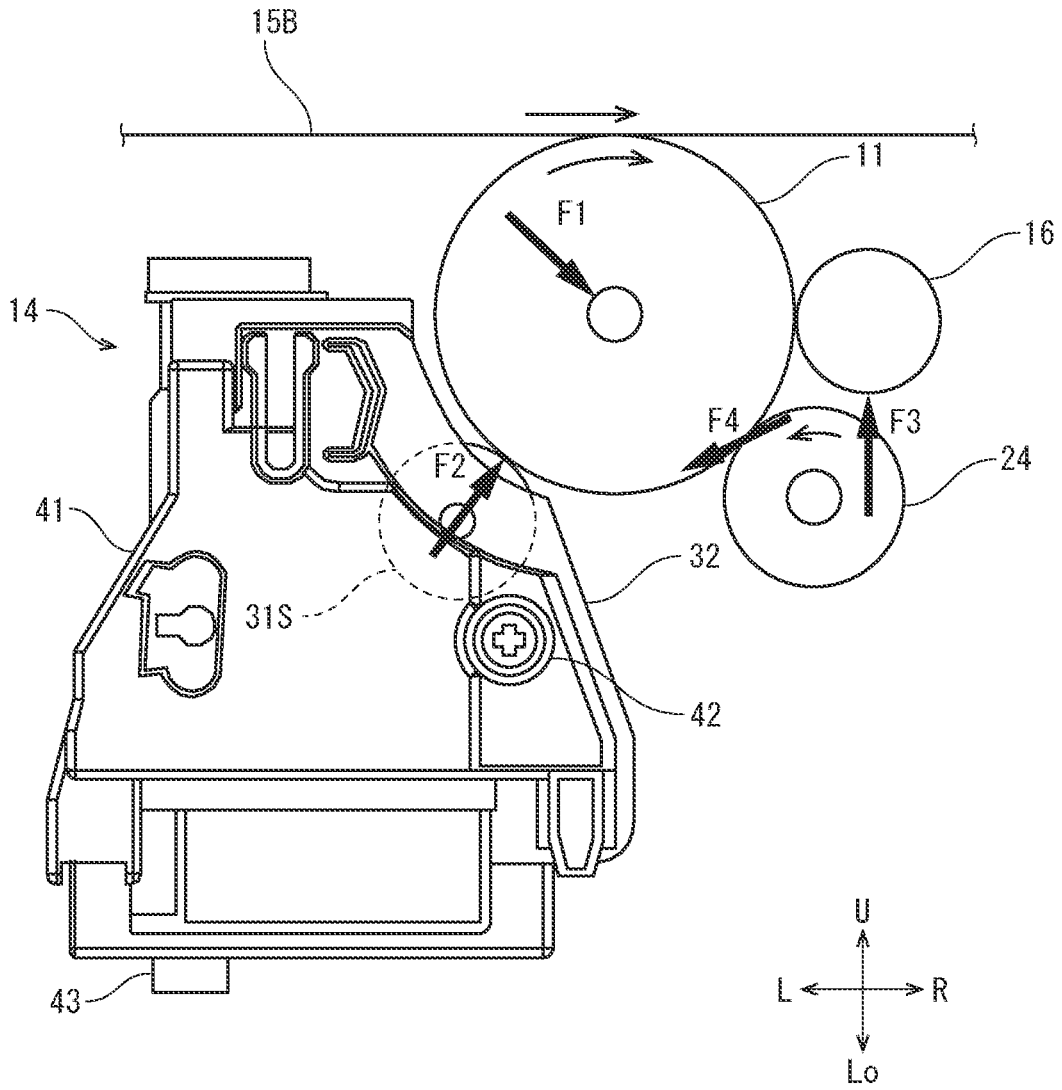
FIG. 12 is a front view showing directions of loads applied on portions of the drum unit according to the embodiment of the present disclosure.

Now, the load applying on each part of the drum unit 21 will be considered. FIG. 12 is a front view showing the direction of the load applying on each part of the drum unit 21. The arrow shown in the drawing indicates only the direction of the load, and the length of the arrow does not indicate the magnitude of the load.

The drum driving gear 24 is engaged with a drum driven gear (not shown) provided on the drum shaft of the photosensitive drum 11. The drum driving gear 24 transmits a driving force generated by a motor (not shown) to the drum driven gear to drive the photosensitive drum 11.

As described above, the hook 60 applies the load F1 on the drum bearing 23. The biasing part 43 of the developing device 14 applies a load F2 to the photosensitive drum 11 through the space regulating member 31S. The joint portion 53 pushes the cleaning device 16 upward by a load F3 through the sealing member 54. The drum driving gear 24 applies a load F4 to the drum driven gear in the direction of the action line. The action line is a straight line crossing a direction forming a pressure angle with respect to a common tangent of the pitch circle of the drum driving gear 24 and the pitch circle of the drum driven gear.

Focusing on the vertical load, the load applying upward on the drum unit 21 is the sum of the upward component of the load F2 and the load F3. The load applying downward on the drum unit 21 is the sum of the downward component of the load F1, the downward component of the load F4, and the gravity acting on the drum unit 21. If the downward acting load is larger than the upward acting load, the lifting of the drum unit 21 is prevented.

Since the load F4 contains the downward component, in other words, the action line of the drum driving gear 24 and the drum driven gear is inclined leftward, an action in which the drum unit 21 is drawn downward is generated. The action has the same effect as increasing of the load F1, so that it becomes possible to use the inexpensive biasing member 64.

On the other hand, focusing on the horizontal load, the lord applied to the drum unit 21 rightward is a sum of the rightward component of the load F1 and the rightward component of the load F2. The load applied to the drum unit 21 leftward is the leftward component of the load F4. If the load applied rightward is larger than the load applied leftward, the drum bearing 23 is pressed against the right side portion 51S of the first notch 51, so that the drum unit 21 is precisely positioned in the horizontal direction.

The printer 1 described above includes the developing device 14 including the developing roller 31; the drum unit 21 which includes the photosensitive drum 11 having an outer circumferential surface facing an outer circumferential surface of the developing roller 31 each other and has the drum bearing 23 (an example of the protrusion) protruding in the axial direction of the photosensitive drum 11; the inner side plate 50 (an example of the side plate) facing the end portion (the end surface) of the drum unit 21 in the axial direction; the upwardly open first notch 51 (an example of the notch) provided in the inner side plate 50 at the attachment position of the drum unit 21; the hook 60 (an example of the turning member) capable of turning along the inner side plate 50 in the direction crossing the axial direction; and the biasing member 64 which biases the hook 60 in a direction close to the first notch 51. The hook 60 is pushed back by the drum bearing 23 inserted into the first notch 51 from above, and when the drum bearing 23 reaches the bottom portion 51B of the first notch 51, the hook 60 presses the drum bearing 23 against the first notch 51 by a load containing a downward component. According to the configuration, the drum unit 21 can be attached by pushing the drum unit 21 downward and detached by pulling the drum unit 21 upward. This makes it easy to perform the operation required to attach and detach the drum unit 21.

Further, according to the printer 1 of the present embodiment, the first notch 51 has the pair of side portions 51S facing each other, and when the drum bearing 23 reaches the bottom portion 51B of the first notch 51, the hook 60 presses the drum bearing 23 against one of the side portions 51S and the bottom portion 51B of the first notch 51. Therefore, it becomes possible to position the drum unit 21 precisely.

Further, according to the printer 1 of the present embodiment, the hook 60 has the curved portion 62 protruded in an arc shape toward the first notch 51 and the planar inclined portion 63 connected to the lower end portion of the curved portion 62, and when the drum bearing 23 inserted into the first notch 51 from above comes into contact with the curved portion 62, the hook 60 is pushed back, and when the drum bearing 23 reaches the bottom portion 51B of the first notch 51, the inclined portion 63 presses the drum bearing 23 against one of the side portions 51S and the bottom portion 51B of the first notch 51. Therefore, it becomes possible to suppress a variation in force by which the drum unit 21 is pushed in.

Further, according to the printer 1 of the present embodiment, the developing device 14 is biased in a direction to bring the developing roller 31 closer to the photosensitive drum 11, and when the drum bearing 23 reaches the bottom portion 51B of the first notch 51, the inclined portion 63 applies a load in a direction crossing a direction in which the developing device 14 is biased, to the drum bearing 23. According to the configuration, because the load applied to the drum bearing 23 by the inclined portion 63 is hardly canceled by the biased developing device 14, it becomes possible to fix the drum unit 21 surely with a small load.

The above embodiment may be modified as follows.

The above embodiment shows an example in which the drum bearing 23 is used as the protrusion, but the protrusion may be provided at a different position from the drum bearing 23.

Instead of the inclined portion 63 of the hook 60, the curved portion 62 may be extended downward from the lower end portion of the curved portion 62 of the above embodiment.

The invention claimed is:

1. An image forming apparatus comprising:

a developing device including a developing roller;

a drum unit which includes a photosensitive drum having an outer circumferential surface facing an outer circumferential surface of the developing roller each other and has a protrusion protruding in an axial direction of the photosensitive drum;

a side plate facing an end surface of the drum unit in the axial direction;

an upwardly open notch having a pair of side portions facing each other, and provided in the side plate at an attachment position of the drum unit;

a turning member having a curved portion protruded in an arc shape toward the notch and a planar inclined portion connected to a lower end portion of the curved portion, and capable of turning in a direction protruding into the notch and in a direction separating from the notch along a direction crossing the axial direction; and a biasing member which biases the turning member in a direction close to the notch, wherein the turning member is pushed back when the protrusion inserted into the notch from above comes into contact with the curved portion, and when the protrusion reaches a bottom portion of the notch, the inclined portion of the turning member presses the protrusion against one of the side portions and the bottom portion of the notch by a load containing a downward component, and the developing device is biased in a direction to bring the developing roller closer to the photosensitive drum, and when the protrusion reaches the bottom portion of the notch, the inclined portion applies a load in a direction crossing a direction in which the developing device is biased, to the protrusion.

2. The image forming apparatus according to claim 1, wherein when the protrusion is inserted into the notch to a position lower than the curved portion, the turning member is pushed back to one of the side portions of the notch by the biasing member.

3. The image forming apparatus according to claim 1, wherein the pair of side portions of the notch are formed along a vertical direction, and the bottom portion is formed along a horizontal direction.

4. An image forming apparatus comprising:

a developing device including a developing roller;

a drum unit which includes a photosensitive drum having an outer circumferential surface facing an outer circumferential surface of the developing roller each other and has a protrusion protruding in an axial direction of the photosensitive drum;

a side plate facing an end surface of the drum unit in the axial direction;

an upwardly open notch provided in the side plate at an attachment position of the drum unit;

a turning member capable of turning in a direction protruding into the notch and in a direction separating from the notch along a direction crossing the axial direction; and a biasing member which biases the turning member in a direction close to the notch, wherein the turning member is pushed back by the protrusion inserted into the notch from above, and when the protrusion reaches a bottom portion of the notch, the turning member presses the protrusion against the notch by a load containing a downward component, and the protrusion is a drum bearing which supports a drum shaft of the photosensitive drum.

* * * * *